US009444188B2

(12) United States Patent
Cox et al.

(10) Patent No.: US 9,444,188 B2
(45) Date of Patent: Sep. 13, 2016

(54) APPLIANCE HAVING A CONTROL HOUSING WITH A CONNECTOR BRACE

(75) Inventors: Rayburn L. Cox, Bridgman, MI (US); Brian T. Etzkorn, Columbus Grove, OH (US); Eugene P. Krausz, Perrysburg, OH (US); Justin D. McIver, Saint Joseph, MI (US); Ryan K. Roth, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 973 days.

(21) Appl. No.: 13/076,830

(22) Filed: Mar. 31, 2011

(65) Prior Publication Data

US 2012/0252246 A1 Oct. 4, 2012

(51) Int. Cl.

| | |
|---|---|
| ***H01R 13/64*** | (2006.01) |
| *H01R 13/58* | (2006.01) |
| *H01R 13/639* | (2006.01) |

(52) U.S. Cl.

CPC ..... *H01R 13/64* (2013.01); *H01R 13/5833* (2013.01); *H01R 13/6395* (2013.01)

(58) Field of Classification Search

USPC ..... 439/501, 144, 142, 133, 259, 131; 361/679.55, 679.57, 679.58

See application file for complete search history.

(56) References Cited

U.S. PATENT DOCUMENTS

| | | | | |
|---|---|---|---|---|
| 4,898,009 | A * | 2/1990 | Lakoski et al. | 70/58 |
| 4,959,021 | A * | 9/1990 | Byrne | 439/310 |
| 4,984,982 | A * | 1/1991 | Brownlie et al. | 439/131 |
| 5,199,888 | A * | 4/1993 | Condra et al. | 439/142 |
| 5,501,607 | A * | 3/1996 | Yoshioka et al. | 439/142 |
| 5,837,942 | A * | 11/1998 | Becker | 174/138 F |
| 6,017,228 | A * | 1/2000 | Verbeek et al. | 439/142 |
| 6,267,608 | B1 * | 7/2001 | Yagi | 439/142 |
| 6,290,518 | B1 * | 9/2001 | Byrne | 439/131 |
| 6,657,868 | B1 | 12/2003 | Hsue | |
| 6,834,919 | B1 * | 12/2004 | Mariano | 312/223.2 |
| 6,836,405 | B2 * | 12/2004 | Alfonso et al. | 361/679.58 |
| 6,935,875 | B1 * | 8/2005 | Holden | 439/144 |
| 6,942,501 | B2 * | 9/2005 | Kissinger et al. | 439/131 |
| 6,970,351 | B2 * | 11/2005 | Perez et al. | 361/679.57 |
| 7,025,627 | B2 * | 4/2006 | Rosenthal et al. | 439/501 |
| 7,045,727 | B2 * | 5/2006 | Chiang et al. | 200/200 |
| 7,443,661 | B2 * | 10/2008 | Xu et al. | 361/679.55 |
| 7,561,420 | B2 * | 7/2009 | Chueh et al. | 361/679.59 |
| 7,594,513 | B2 | 9/2009 | Vanderroest et al. | |
| 7,688,574 | B2 | 3/2010 | Zadesky et al. | |
| 7,820,929 | B2 | 10/2010 | Thorp et al. | |
| 2004/0104037 | A1 * | 6/2004 | Solet | 174/50 |
| 2007/0211422 | A1 | 9/2007 | Liu et al. | |

* cited by examiner

*Primary Examiner* — Alexander Gilman

(57) ABSTRACT

An appliance having a control housing assembly for operably storing a printed circuit board to which corresponding wiring connectors may be connected to couple electrical components to the printed circuit board.

26 Claims, 7 Drawing Sheets

APPLIANCE HAVING A CONTROL HOUSING WITH A CONNECTOR BRACE

BACKGROUND OF THE INVENTION

Contemporary appliances, an example of which includes automatic dishwashers, perform cycles of operation and often have electrical and mechanical components responsible for implementing the cycle of operation of the appliance, with one or more of the components controlling the operation of the other components. For example, a controller, such as a microprocessor-based controller, having a printed circuit board (PCB) with memory, as well as a user interface, such as a control panel or keypad, may issue commands to the other components to control them to implement a cycle of operation selected by a user via the user interface.

SUMMARY OF THE INVENTION

The invention relates to a control housing assembly for operably storing a printed circuit board having an edge along which are provided edge connectors to which corresponding wiring connectors are connected to couple electrical components to the printed circuit board, the control housing assembly. The housing defines an interior for receiving the printed circuit board and has a slot through which the edge connectors are accessible for connection with the wiring connectors. A connector brace is movably mounted to the housing for movement to a latching position where the connector brace overlies the slot and retains properly inserted wiring connectors in a connected relationship with the corresponding edge connectors. The connector brace has at least one projection for at least one of the wiring connectors and the connector brace and the at least one projection are sufficiently rigid to apply a force to any improperly inserted wiring connector to properly insert the improperly inserted wiring connector on to the corresponding edge connector as the connector brace is moved to the latching position.

DESCRIPTION OF EMBODIMENTS OF THE INVENTION

Figure 1:
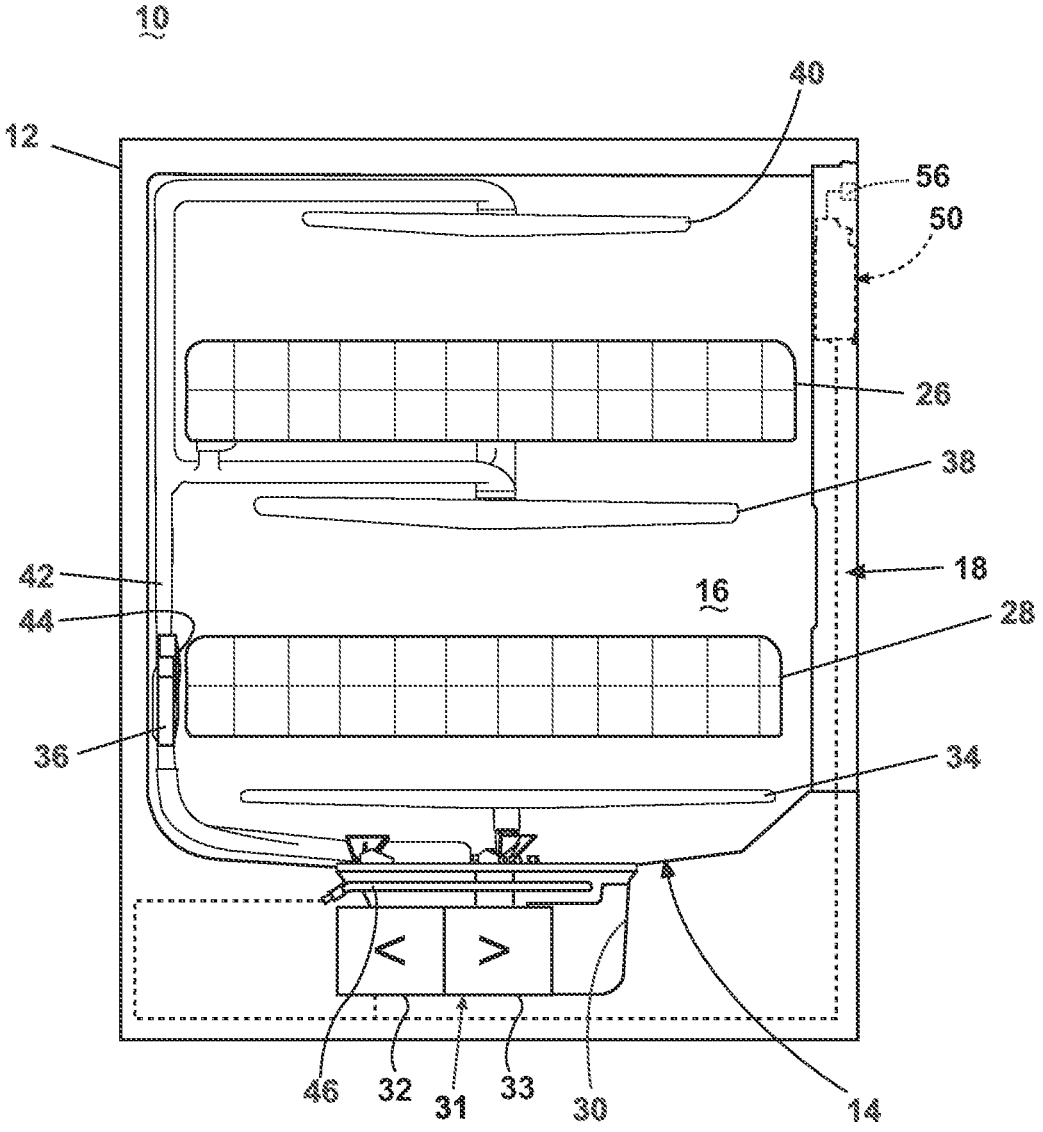
FIG. 1 is a schematic, cross-sectional view of a dishwasher according to a first embodiment of the invention.

In FIG. 1, a first embodiment of the invention is illustrated in the environment of an automated dishwasher 10 having a chassis 12. The chassis 12 defines an interior and may be a frame with or without panels mounted to the frame. The dishwasher 10 shares many features of a conventional automated dishwasher, which will not be described in detail herein except as necessary for a complete understanding of the invention. The chassis 12 houses an open-faced wash tub 14 that at least partially defines a treating chamber 16, having an open face, for washing utensils. A door assembly 18 may be movably mounted to the dishwasher 10 for movement between opened and closed positions to selectively open and close the open face of the wash tub 14. Thus, the door assembly provides accessibility to the treating chamber 16 for the loading and unloading of dishes or other washable items.

It should be appreciated that the door assembly 18 may be secured to the lower front edge of the chassis 12 or to the lower front edge of the wash tub 14 via a hinge assembly (not shown) configured to pivot the door assembly 18. When the door assembly 18 is closed, user access to the treating chamber 16 may be prevented, whereas user access to the treating chamber 16 may be permitted when the door assembly 18 is open.

Utensil holders, illustrated in the form of upper and lower utensil racks 26, 28, are located within the treating chamber 16 and receive dishes for washing. The upper and lower racks 26, 28 are typically mounted for slidable movement in and out of the treating chamber 16 for ease of loading and unloading. Other utensil holders may be provided, such as a silverware basket. As used in this description, the term "utensil(s)" is intended to be generic to any item, single or plural, that may be treated in the dishwasher 10, including, without limitation; dishes, plates, pots, bowls, pans, glassware, and silverware.

While the present invention is described in terms of a conventional dishwashing unit as illustrated in FIG. 1, it could also be implemented in other types of dishwashing units such as in-sink dishwashers or drawer dishwashers including drawer dishwashers having multiple compartments. For drawer-type dishwashers, the surrounding cabinet in combination with the sliding drawer takes the place of the door assembly 18.

A spray system is provided for spraying liquid in the treating chamber 16 and is provided in the form of a first lower spray assembly 34, a second lower spray assembly 36, a rotating mid-level spray arm assembly 38, and/or an upper spray arm assembly 40. Upper sprayer 40, mid-level rotatable sprayer 38 and lower rotatable sprayer 34 are located, respectively, above the upper rack 26, beneath upper rack 26, and beneath the lower rack 24 and are illustrated as rotating spray arms. The second lower spray assembly 36 is illustrated as being located adjacent the lower utensil rack 28 toward the rear of the treating chamber 16. The second lower spray assembly 36 is illustrated as including a vertically oriented distribution header or spray manifold 44. Such a spray manifold is set forth in detail in U.S. Pat. No. 7,594,513, issued Sep. 29, 2009, and titled "Multiple Wash Zone Dishwasher," which is incorporated herein by reference in its entirety.

A recirculation system is provided for recirculating liquid from the treating chamber 16 to the spray system. The recirculation system may include a sump 30 and a pump assembly 31. The sump 30 collects the liquid sprayed in the treating chamber 16 and may be formed by a sloped or recess portion of a bottom wall of the tub 14. The pump assembly 31 may include both a drain pump 32 and a recirculation pump 33. The drain pump 32 may draw liquid from the sump 30 and pump the liquid out of the dishwasher 10 to a household drain line (not shown). The recirculation pump 33 may draw liquid from the sump 30 and the liquid may be simultaneously or selectively pumped through a supply tube 42 to each of the assemblies 34, 36, 38, 40 for selective spraying. While not shown, a liquid supply system may include a water supply conduit coupled with a household water supply for supplying water to the treating chamber 16.

A heating system including a heater 46 may be located within the sump 30 for heating the liquid contained in the sump 30.

A controller 50 may also be included in the dishwasher 10, which may be operably coupled with various components of the dishwasher 10 to implement a cycle of operation. The controller 50 may be located within the door 18 as illustrated, or it may alternatively be located somewhere within the chassis 12. The controller 50 may also be operably coupled with a control panel or user interface 56 for receiving user-selected inputs and communicating information to the user. The user interface 56 may include operational controls such as dials, lights, switches, and displays enabling a user to input commands, such as a cycle of operation, to the controller 50 and receive information.

Figure 2:
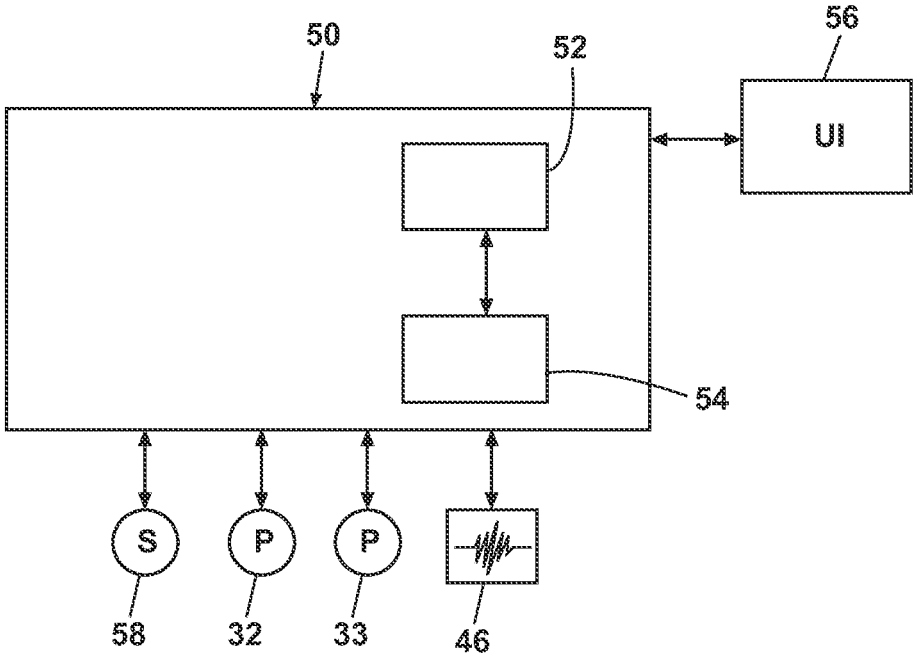
FIG. 2 is a schematic view of a controller of the dishwasher of FIG. 1.

As illustrated schematically in FIG. 2, the controller 50 may be coupled with the heater 46 for heating the wash liquid during a cycle of operation, the drain pump 32 for draining liquid from the treating chamber 16, the recirculation pump 33 for recirculating the wash liquid during the cycle of operation. The controller 50 may be provided with a memory 52 and a central processing unit (CPU) 54. The memory 52 may be used for storing control software that may be executed by the CPU 54 in completing a cycle of operation using the dishwasher 10 and any additional software. For example, the memory 52 may store one or more pre-programmed cycles of operation that may be selected by a user and completed by the dishwasher 10.

The controller 50 may also receive input from one or more sensors 58. Non-limiting examples of sensors that may be communicably coupled with the controller 50 include a temperature sensor, turbidity sensor to determine the soil load associated with a selected grouping of utensils, such as the utensils associated with a particular area of the treating chamber and a sensor for determining a load value at selected locations within the dishwasher 10. The load value may be reflective of either or both a utensil load, i.e. the number and/or size of the utensils in the dishwasher, and/or a soil load, i.e. the quantity of soil on the utensils.

Figure 3:
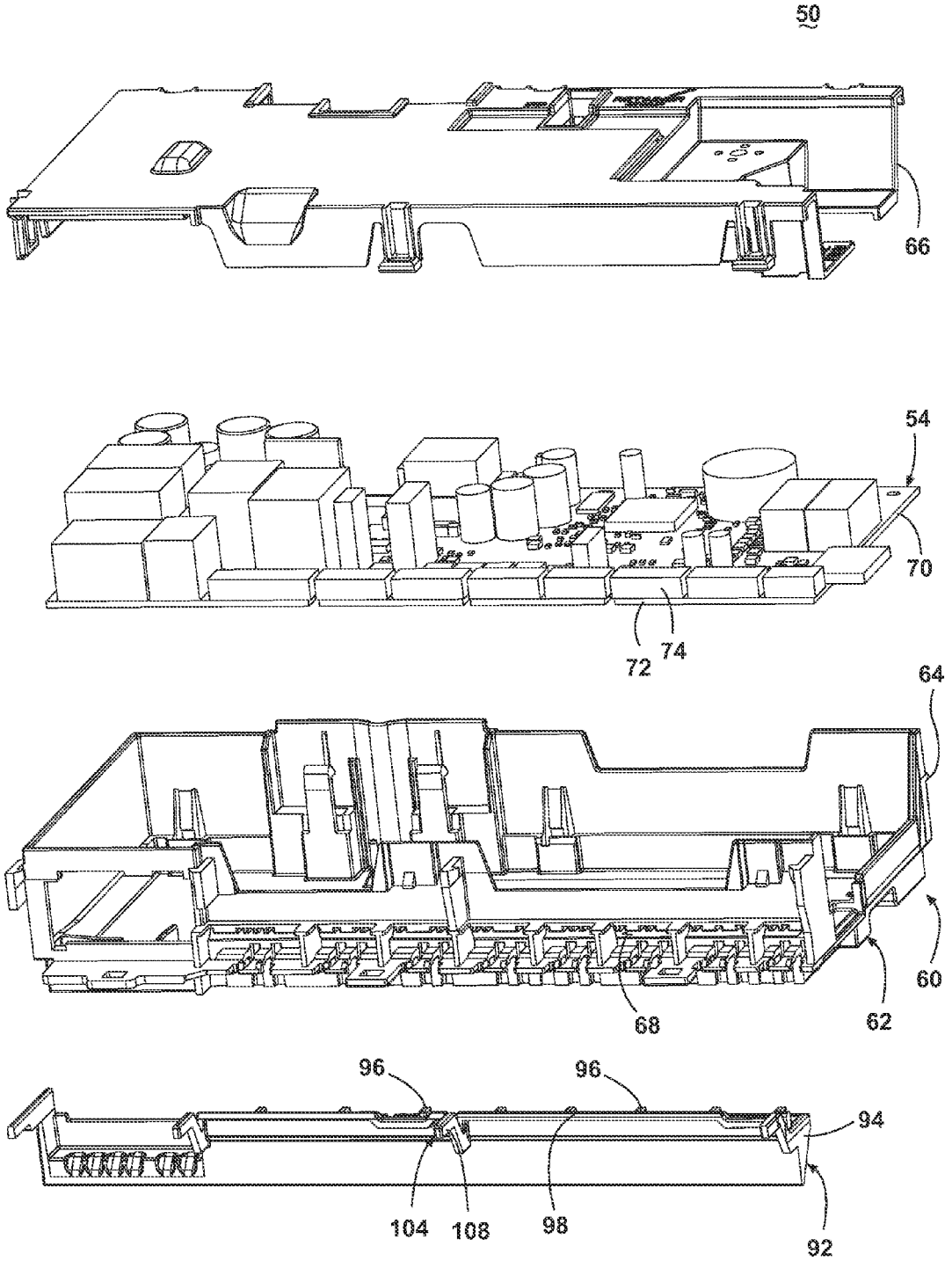
FIG. 3 is an exploded perspective view of an exemplary control housing assembly including a controller, housing and connector brace which may be used in the dishwasher of FIG. 1.

FIG. 3 illustrates an exploded view of exemplary components, which may make up the controller 50 in the form of a microprocessor-based controller implemented in a printed circuit board (PCB) 54, which is housed in a control housing assembly 60.

The PCB 54 may include a board 70 on which parts including memory, a microprocessor, as well as other circuit elements (e.g., resistors, diodes and capacitors) may be mounted. The PCB 54 has an edge 72 along which multiple edge connectors 74 are provided, that may supply power, grounding, and data transmission to the PCB 54.

The control housing assembly 60 includes a housing 62 and a connector brace 92. The housing 62 is illustrated as a separate base 64 and cover 66, which may be assembled to define an interior for receiving the PCB 54. The base 64 and cover 66 may include multiple cooperating prongs and slots for securing the base 64 and cover 66 together. The housing 62 may be provided with support members for retaining and securing the PCB 54 within the interior of the housing 62. Additionally, the housing 62 may include a slot 68 through which the PCB 54 may be accessible. More specifically, the base 64 has been illustrated as having a slot 68. The edge connectors 74 may be accessible through the slot 68 when the PCB 54 is mounted within the housing 62.

Figure 4:
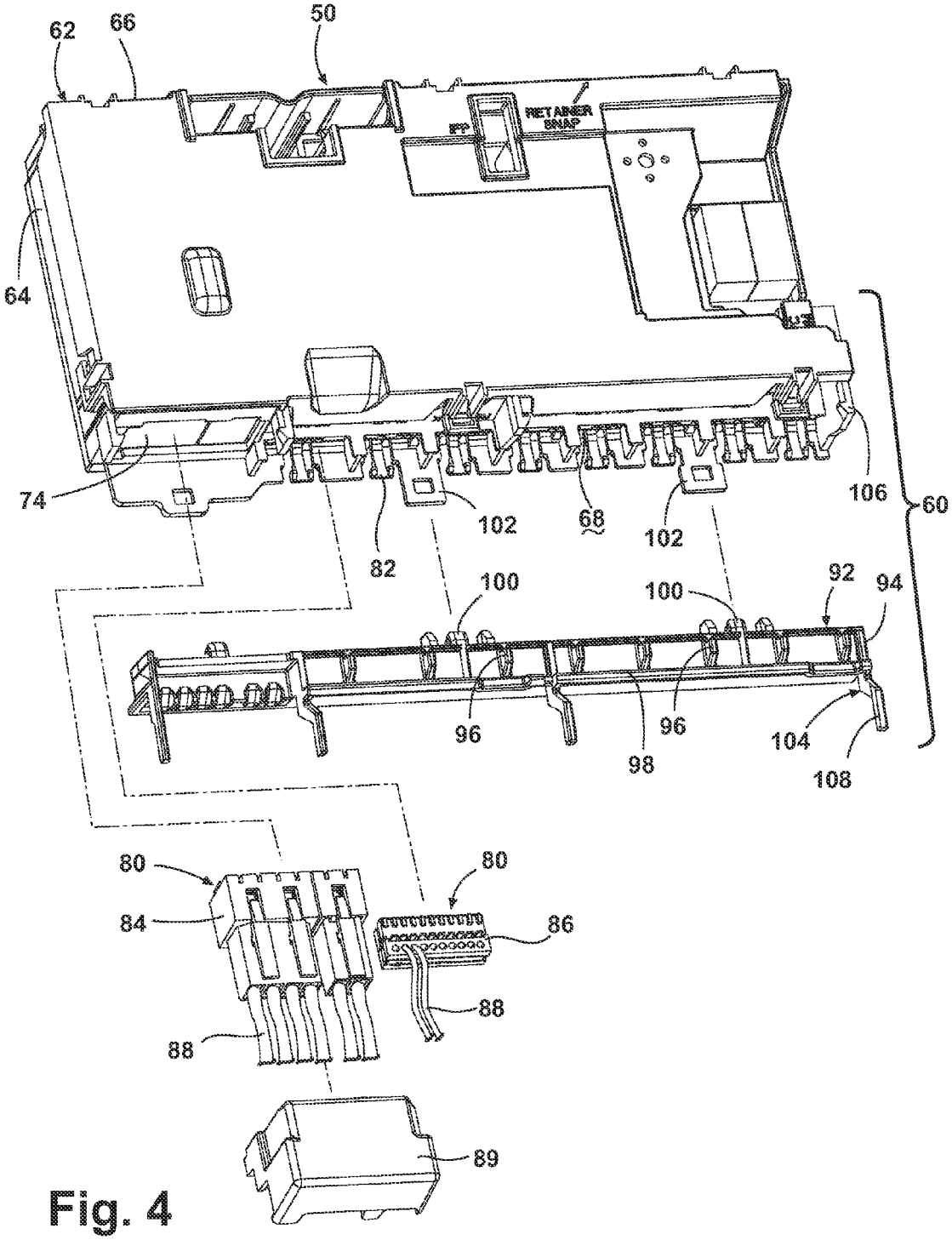
FIG. 4 is a partially assembled control housing assembly of FIG. 1, with the connector brace shown unassembled.

Referring to FIG. 4, prior to describing the connector brace 92, a brief digression into the electrical systems of the appliance will provide a more complete understanding. Wiring connectors 80 are provided within the electrical system of the appliance to couple, for power supply and/or data, the various electrical elements to the PCB 54. The physical connection between the edge connectors 74 and wiring connectors 80 is push/pull in that the wiring connectors 80 need only be pushed onto the corresponding edge connector 74 to be installed and pulled off of to be uninstalled. The term "onto" is not meant to be limiting and it has been contemplated that the wiring connectors 80 may be pushed into or over a corresponding edge connector 74. At least one of the edge connectors 74, the wiring connectors 80, and the housing 62 may have a latching feature 82 to ensure the wiring connector 80 is securely coupled with its corresponding edge connector 74 when it is properly inserted thereon.

Two exemplary wiring connectors 80 have been illustrated in FIG. 4 and by way of non-limiting example include a power connector 84 and a data connector 86. The power connector 84 may provide the PCB 54 with power from a power source (not shown). The data connector 86 may make a wired connection between the PCB 54 and the other components of the dishwasher 10. Each of the wiring connectors 80 has wires 88 extending from it and couple to the various components, power supplies, etc. An optional cover 89 may be coupled with the housing 62 to enclose the power connector 84.

The connector brace 92 may include an elongated body 94, which may extend the length of the housing 62. The body 94 may include multiple projections 96, which are spaced along the length of the body 94. It has been contemplated that the number of projections and their spacing along the length of the body 94 may be varied. A rib 98 may project from the body 94 and may extend along at least a portion of its length.

Figure 5:
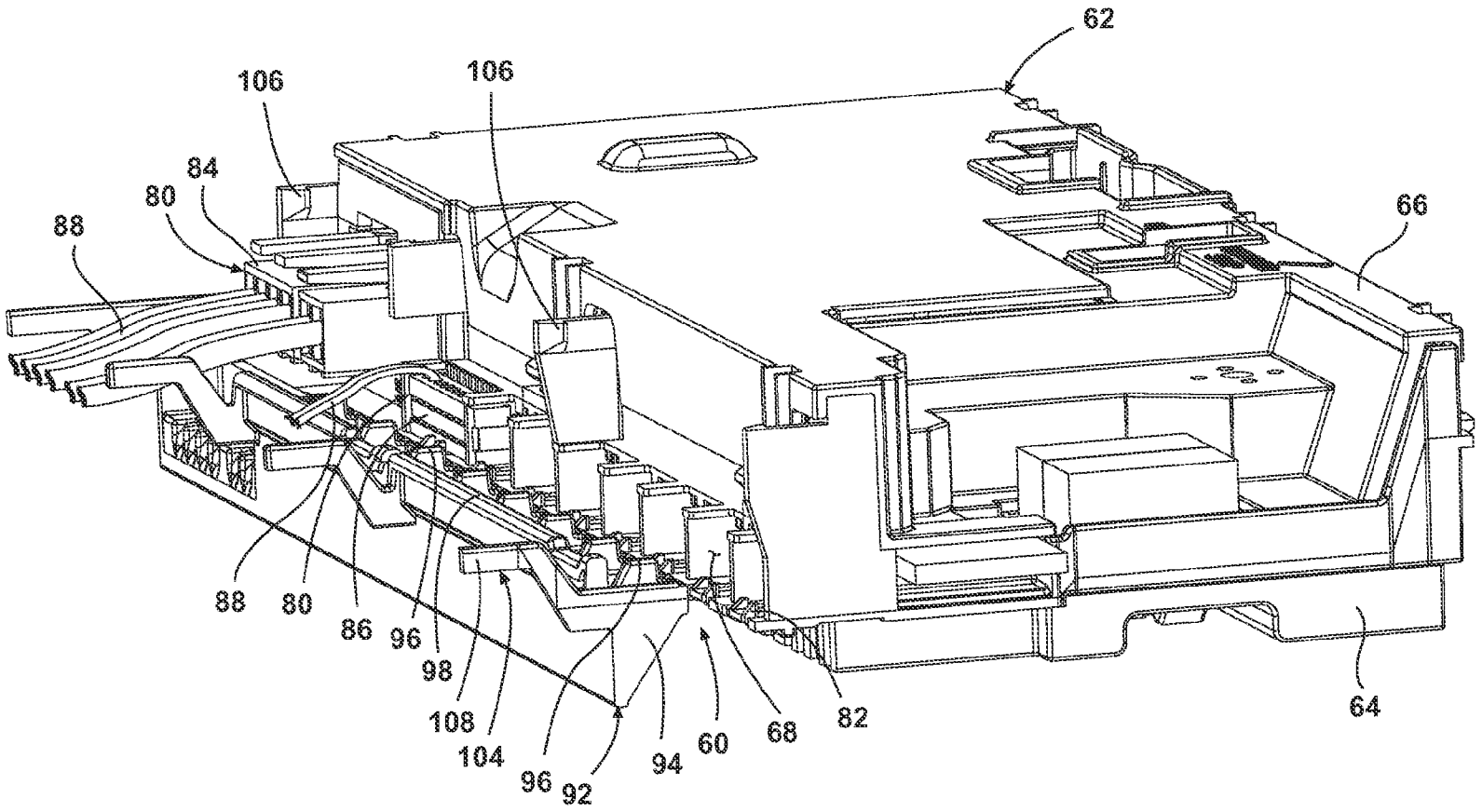
FIG. 5 is a perspective view of the assembled control housing assembly with the connector brace in an unlatched position.
Figure 6:
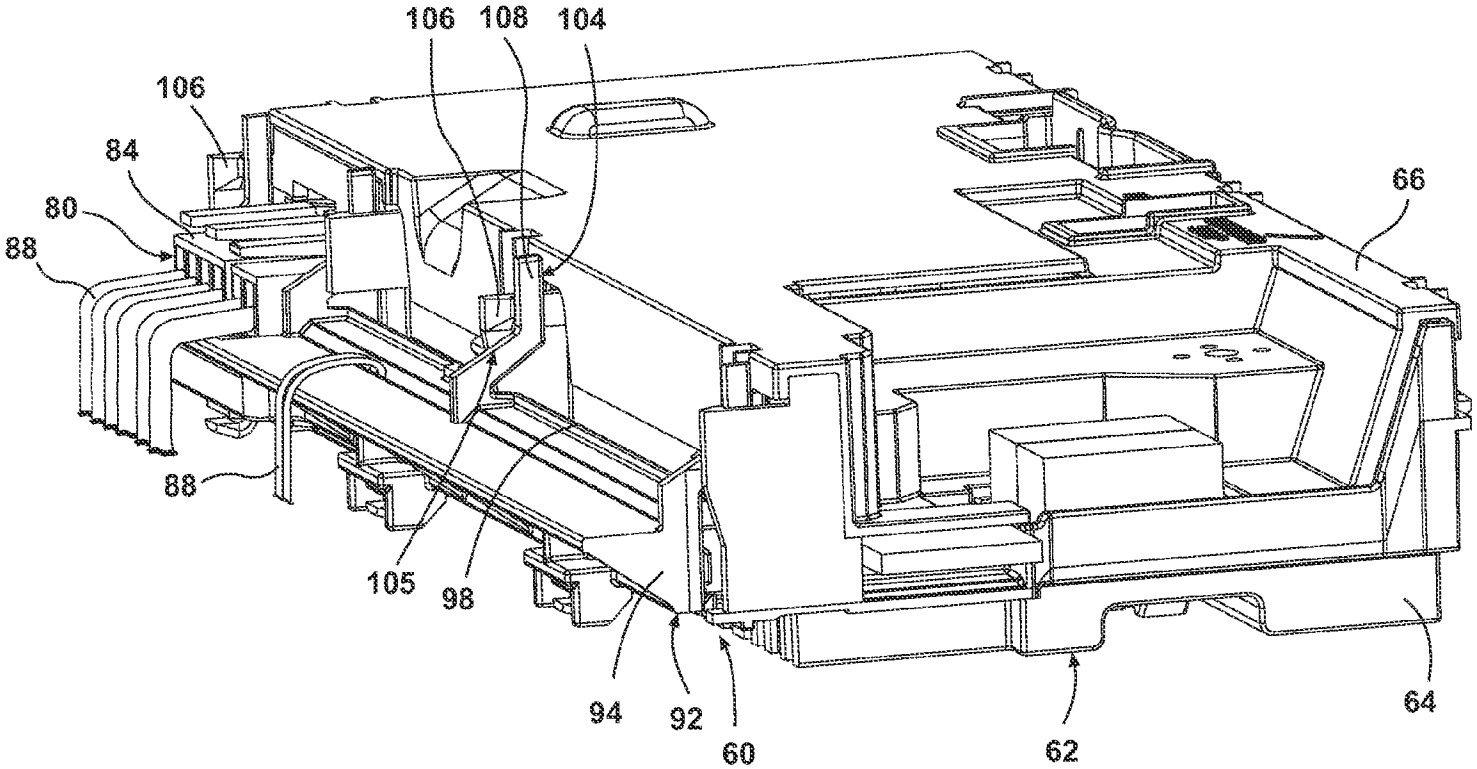
FIG. 6 is a perspective view of the assembled control housing with the connector brace in a latching position.

The body 94 may be hingedly mounted to the housing 62 for movement between an unlatched position (FIG. 5) and a latching position (FIG. 6). Any suitable hinge assembly may be used. By way of non-limiting example, a hook 100 may be provided on the connector brace 92 and a pin 102 may be provided on the housing 62. The hook 100 may catch the pin 102 to form a hinge between the housing 62 and connector brace 92. Alternatively, the hook 100 may be located on the housing 62 and the pin 102 may be located on the connector brace 92. The connector brace 92 may also include a lever 104 operably coupled with the body 94 such that the lever 104 may be grasped by a user to rotate the connector brace 92 about the hinge assembly to the latching position.

As illustrated more clearly in FIG. 6, the control housing assembly 60 may include a latch 105 for holding the connector brace 92 in the latching position. The latch 105 may include a hook 106 on one of the housing 62 and connector brace 92 and a complementary catch 108 on the other of the housing 62 and connector brace 92. It has been contemplated that the lever 104 may form a portion the catch 108. Alternatively, it has been contemplated that the catch may be a separate portion. As illustrated, there may be multiple pairs of hooks 106 and catches 108 spaced along the connector brace 92 and housing 62 to form multiple latches 105 for holding the connector brace 92 in the latching position.

The operation of the connector brace 92 may be started with brief reference to FIG. 5, which illustrates the connector brace 92 in an un-rotated/unlatched position and FIG. 6, which illustrates the connector brace 92 in a rotated/latching position. When the connector brace 92 is moved to the latching position it overlies the slots 68 and may retain properly inserted wiring connectors 80 in a connected relationship with the corresponding edge connectors 74.

Figure 7A:
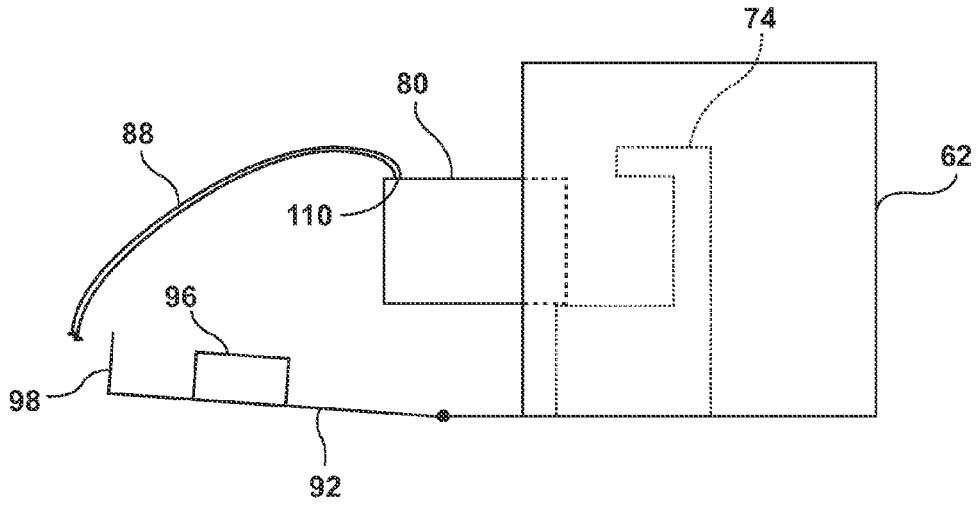
FIGS. 7A-7C are schematic side views of the control housing illustrated in FIG. 3 and show the movement of a connector brace.
Figure 7B:
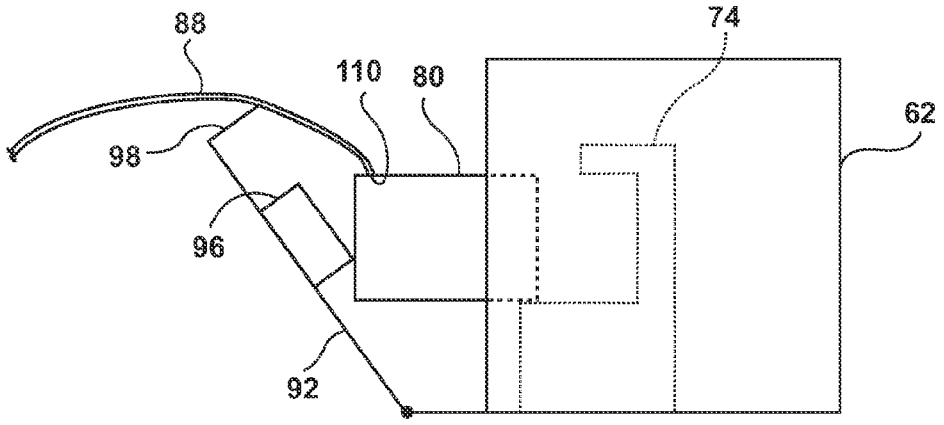

The connector brace performs several functions as it rotates into the latching position. These functions are best described with respect to FIGS. 7A-7C. For orientation purposes, FIG. 7A illustrates the connector brace 92 in an un-rotated position, FIG. 7B illustrates the connector brace 92 in an intermediate position wherein it has been partially rotated, and FIG. 7C illustrates the connector brace in a fully rotated and latching position.

As the connector brace 92 is hingedly rotated from the un-rotated position (FIG. 7A) to a partially rotated position (FIG. 7B) the projections 96 are brought into contact with an improperly inserted wiring connector 80. In this manner, the projection 96 may act to abut the improperly inserted wiring connector 80 as the connector brace 92 is moved into the latching position. The continued rotation of the connector brace 92 to the latching position drives the projection 96 against the improperly inserted wiring connector 80 to apply a force to the improperly inserted wiring connector 80. The force is sufficient to properly insert the wiring connector 80 onto the corresponding edge connector 74 such that it may be fully inserted into the housing 62. Both the connector brace 92 and the projection 96 are sufficiently rigid so as to apply a sufficient force to any improperly inserted wiring connector 80 to properly insert the improperly inserted wiring connector 80 on to the corresponding edge connector 74 such that it may be fully received in the housing 62. Prior connector braces suffered from being too flexible such that when they were closed, the connector brace would flex and bow outwardly, leaving the wiring connector improperly inserted, instead of properly inserting the wiring connector.

Figure 7C:
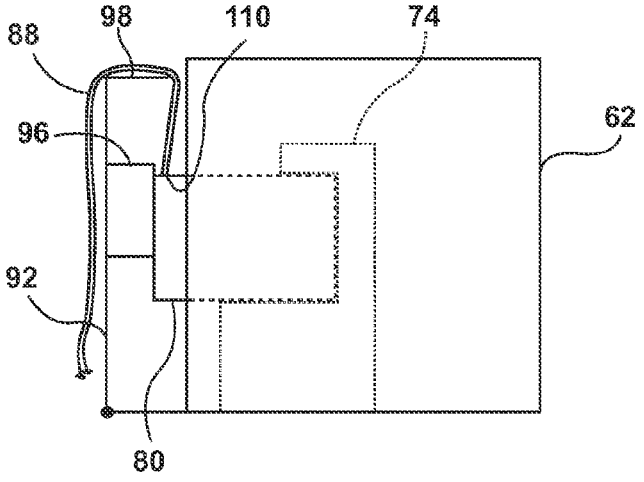

A shown in FIG. 7C, the projection 96 may abut the wiring connector 80 when the connector brace 92 is in the latching position. In this manner, the projection 96 may also apply a retaining force to the wiring connector 80 when the connector brace 92 is in the latching position. As may be understood from the above described embodiment, the connector brace 92 may not be moved into the latching position if any wiring connectors 80 remain improperly inserted after force is applied to the improperly inserted wiring connectors 80 by the connector brace 92. As the projections 96 apply a force to the wiring connectors 80 they keep the wiring connectors 80 under tension, which results in the wiring connectors 80 vibrating together with the rest of the control housing assembly 60 and results in less fretting corrosion, which may be caused by vibration and movement between terminals on the wiring connectors 80 and the mating terminals on the edge connectors 74.

When the connector brace 92 is in the latching position, the rib 98 may be positioned above an interface 110 of the wires 88 and the wiring connector 80 and at least partially within an orthogonal projection of the interface 110. As may more easily be seen in FIG. 7C, the rib 98 may be positioned above the slots when the connector brace 92 is in the latching position. As such, the rib 98 may provide a structure over which the wires 88 may drape when the connector brace 92 is in the latching position. In this manner, the rib 98 may provide a strain relief element for the wires 88 of the wiring connector 80 and provide strain relief for the wires 88 when the connector brace 92 is in the latching position. Thus, any accidental pulling on the wires 88 will apply a force to the rib 98, which will reduce the likelihood that the wires 88 would be pulled out of the connector 80.

The connector brace 92 also performs a tensioning function that reduces the likelihood of fretting corrosion. The rib 98 abuts the wires 88 and applies tension to the wires 88 when the connector brace 92 is in the latching position. Thus, the rib 98 may also act as a tensioner that applies a tension force to the wires 88 of the wiring connector 80 when the connector brace 92 is in the latching position. Once the wiring connectors 80 are properly installed and the connector brace 92 is latched, the control housing assembly 60 may be installed into the dishwasher 10. Keeping the wires 88 under tension results in the wires 88 vibrating together with the rest of the control housing assembly 60 and results in less fretting corrosion, which may be caused by vibration. Further, as the wiring connectors 80 are held in place by the connector brace 92 and the wires 88 drape over the rib 98 the connector brace 92 provides a strain relief element as it acts to take weight off of the mating terminals on the controller, which results in less damage to solder joints in the controller. The ability of the wires to drape over the rib also acts to dampen vibrations of the wires resulting in less fretting corrosion.

Although it has been described that at least one of the edge connector and wiring connector may include a latch to ensure the two are properly coupled, the latch is not effective if the wiring connector is not fully inserted onto the edge connector during assembly. The apparatus described above allows the connector brace to properly insert any improperly inserted wiring connectors. If the connector brace is unable to rectify the improper insertion of the wiring connector, it will not latch, alerting a user that the connectors are not properly inserted and allowing for rectification of the problem. In this manner, the connector brace results in secure connections between the edge connectors on the controller and the wiring connectors. The connector brace also acts to cover the wiring connectors and any un-used slots such that the connector brace may act as a portion of the enclosure for the PCB and its wiring connections.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A control housing assembly for operably storing a printed circuit board having an edge along which are provided edge connectors to which corresponding wiring connectors are connected to couple electrical elements to the printed circuit board, the control housing assembly comprising:

a housing, defining an interior for receiving the printed circuit board, and having a slot through which the edge connectors are accessible for connection with the wiring connectors; and a connector brace hingedly mounted to the housing for movement to a latching position where the connector brace overlies the slot and retains properly inserted wiring connectors in a connected relationship with corresponding edge connectors;

wherein the connector brace is physically configured such that movement of the connector brace to the latching position will contact any improperly inserted wiring connector and is sufficiently rigid to apply a force to any improperly inserted wiring connector to properly insert the improperly inserted wiring connector on to the corresponding edge connector.

2. The control housing assembly of claim 1 wherein the connector brace comprises a strain relief element for wires of the wiring connectors to provide strain relief for the wires when the connector brace is in the latching position.

3. The control housing assembly of claim 2 wherein the strain relief element comprises a structure on the connector brace over which the wires may drape.

4. The control housing assembly of claim 3 wherein the structure comprises a rib positioned above the slot when the connector brace is in the latching position.

5. The control housing assembly of claim 1 wherein the connector brace comprises a tensioner that applies a tension force to at least one of the wiring connectors and the wires of the wiring connectors when the connector brace is in the latching position.

6. The control housing assembly of claim 5 wherein the tensioner comprises a structure on the connector brace that abuts at least one of the wiring connectors and the wires of the wiring connectors and applies tension thereto when the connector brace is in the latching position.

7. The control housing assembly of claim 6 wherein the structure comprises a rib positioned above an interface of the wires and the wiring connectors and at least partially within an orthogonal projection of the interface.

8. The control housing assembly of claim 6 wherein the structure comprises at least one projection that abuts the wiring connectors when the connector brace is in the latching position.

9. The control housing assembly of claim 1 further comprising a latch for holding the connector brace in the latching position.

10. The control housing assembly of claim 9 wherein the latch comprises a hook on one of the housing and connector brace and a complementary catch on the other of the housing and connector brace.

11. The control housing assembly of claim 10 wherein there are multiple pairs of hooks and catches spaced along the connector brace and housing.

12. The control housing assembly of claim 10 wherein the connector brace comprises a lever that can be grasped by a user to move the connector brace to the latching position and a portion of the lever forms the catch.

13. The control housing assembly of claim 1 further comprising a hook provided on one of the housing and connector brace and a pin provided on the other of the housing and connector brace, with the hook catching the pin to form a hinge between the housing and connector brace.

14. The control housing assembly of claim 1 wherein a physical configuration of the connector brace comprises at least one projection that abuts an improperly inserted wiring connector as the connector brace is moved into the latching position.

15. The control housing assembly of claim 14 wherein the at least one projection abuts the wiring connector when the connector brace is in the latching position.

16. The control housing assembly of claim 15 wherein the at least one projection applies a retaining force to the wiring connector when the connector brace is in the latching position.

17. The control housing assembly of claim 1, wherein the connector brace may not be moved into the latching position if any wiring connectors remain improperly inserted after force is applied to the improperly inserted wiring connectors by the connector brace.

18. A control housing assembly for operably storing a printed circuit board having an edge along which are provided edge connectors to which corresponding wiring connectors are connected to couple electrical components to the printed circuit board, the control housing assembly comprising:

a housing, defining an interior for receiving the printed circuit board, and having a slot through which the edge connectors are accessible for connection with the wiring connectors; and a connector brace movably mounted to the housing for movement to a latching position where the connector brace overlies the slot and retains properly inserted wiring connectors in a connected relationship with corresponding edge connectors;

wherein the connector brace has at least one projection for at least one of the wiring connectors and the connector brace and the at least one projection are sufficiently rigid to apply a force to any improperly inserted wiring connector to properly insert the improperly inserted wiring connector on to the corresponding edge connector as the connector brace is moved to the latching position.

19. The control housing assembly of claim 18 wherein the connector brace comprises a strain relief element for wires of the wiring connectors to provide strain relief for the wires when the connector brace is in the latching position.

20. The control housing assembly of claim 19 wherein the connector brace comprises a tensioner that applies a tension force to at least one of the wiring connectors and the wires of the wiring connectors when the connector brace is in the latching position.

21. The control housing assembly of claim 20 wherein the at least one projection forms the tensioner that applies a tension force to the wiring connectors when the connector brace is in the latching position.

22. The control housing assembly of claim 20 wherein the connector brace comprises a rib positioned above an interface of the wires and the wiring connectors and at least partially within an orthogonal projection of the interface when the connector brace is in the latching position to form the strain relief element and the tensioner.

23. The control housing of claim 21 wherein the rib dampens vibrations of the wires when the connector brace is in the latching position.

24. The control housing assembly of claim 21, further comprising a latch for holding the connector brace in the latching position.

25. The control housing assembly of claim 18 wherein the connector brace may not be moved into the latching position if any wiring connectors remain improperly inserted after force is applied to the improperly inserted wiring connectors by the connector brace and the at least one projection.

26. The control housing assembly of claim 18 wherein when the connector brace is in the latching position the connector brace overlies the slot such that the edge connectors having no corresponding wire connectors are enclosed.

* * * * *